US007219970B2

(12) United States Patent
Cruz-Uribe et al.

(10) Patent No.: US 7,219,970 B2
(45) Date of Patent: May 22, 2007

(54) METHOD AND A SYSTEM FOR SINGLE LIGAMENT FLUID DISPENSING

(75) Inventors: Tony S. Cruz-Uribe, Corvallis, OR (US); Jeffrey A Nielsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 211 days.

(21) Appl. No.: 10/685,842

(22) Filed: Oct. 14, 2003

(65) Prior Publication Data

US 2005/0078131 A1 Apr. 14, 2005

(51) Int. Cl.
*B41J 29/38* (2006.01)

(52) U.S. Cl. ..... 347/9; 347/12

(58) Field of Classification Search ..... 347/2, 347/9, 12, 107; 438/674
See application file for complete search history.

(56) References Cited

U.S. PATENT DOCUMENTS 4,686,539 A 8/1987 Schmidle et al.
5,113,199 A * 5/1992 Chan et al. ..... 347/87
5,285,215 A 2/1994 Liker
5,506,607 A * 4/1996 Sanders et al. ..... 347/1
5,740,051 A * 4/1998 Sanders et al. ..... 700/119
5,916,358 A * 6/1999 Bagchi et al. ..... 106/31.59
6,151,050 A * 11/2000 Hosono et al. ..... 347/70
6,193,361 B1 * 2/2001 Wen ..... 347/84
6,214,279 B1 4/2001 Yang et al.
6,224,205 B1 * 5/2001 Akahira et al. ..... 347/107
6,450,602 B1 * 9/2002 Lubinsky et al. ..... 347/9
6,471,800 B2 10/2002 Jang et al.
6,503,831 B2 * 1/2003 Speakman ..... 438/674
6,846,054 B2 * 1/2005 Ishinaga et al. ..... 347/5
2003/0010283 A1 1/2003 Yamazaki et al.
2003/0067500 A1 4/2003 Fujimara et al.

FOREIGN PATENT DOCUMENTS

EP 0 894 625 A2 2/1999

* cited by examiner

*Primary Examiner*—Stephen Meier
*Assistant Examiner*—Leonard Liang

(57) ABSTRACT

A method of dispensing a single ligament of fluid includes ejecting a first quantity of fluid from an inkjet dispenser toward a substrate, and ejecting a second quantity of fluid from the inkjet dispenser toward the substrate, wherein the second quantity of fluid is ejected from the inkjet dispenser at a frequency sufficient that the second quantity of fluid catches the first quantity of fluid thereby forming a single ligament of fluid prior to contacting the substrate.

22 Claims, 16 Drawing Sheets

METHOD AND A SYSTEM FOR SINGLE LIGAMENT FLUID DISPENSING

BACKGROUND

Inkjet technologies are used for material deposition in a number of applications including text and graphic printing, solid freeform fabrication, and creating electronic devices. When used to form a desired image, traditional inkjet dispensers eject discrete droplets of fluid onto a print media at designated locations. The locations for the discrete droplets are chosen such that the droplets will approximate a continuous line. However, high precision print images and line approximations are often difficult to achieve because as a series of discrete droplets arrive at a print media location, contact with the print media may cause jagged edges and gaps. Moreover, misguided satellite droplets may wander out of a desired target area further decreasing the precision of the resulting image.

Similarly, solid freeform fabrication methods may incorporate inkjet technology to eject discrete droplets of build and/or support material in a desired pattern or orientation to form a desired three-dimensional object. These solid freeform fabrication methods and any other application of inkjet dispensing that relies on the dispensing of discrete droplets to approximate a continuous line have also suffered from a lack of continuity or smoothness due to the characteristics of dispensing discrete droplets of fluid in designated locations.

One traditional method used to smooth edges when selectively depositing a fluid with an inkjet dispenser is to increase the resolution of the dispenser. By increasing the number of discrete droplets that may be dispensed per square inch (dpi), more precision and subsequently smoother edges of a dispensed object may be achieved. However, in order to increase the droplets per square inch produced by a dispenser, a higher frequency of droplet emission and/or a longer dispensing duration is required.

Alternatively, the rough edges of two-dimensional lines or images have traditionally been smoothed through the insertion of additional smaller droplets into the voids that are created along the edges of deposited fluid. While this method is somewhat effective in smoothing the edges of lines or images, in order to form both the images being created as well as deposit smaller droplets, either a method of operating an inkjet fluid deposition apparatus to deliver multiple sized droplets of fluid must be developed or separate jets dedicated to various fluid droplet sizes must be added thereby increasing the cost, sometimes prohibitively so, of the fluid dispensing device.

SUMMARY

A method of dispensing a single ligament of fluid includes ejecting a first quantity of fluid from an inkjet dispenser toward a substrate, and ejecting a second quantity of fluid from the inkjet dispenser toward the substrate, wherein the second quantity of fluid is ejected from the inkjet dispenser at a frequency sufficient that the second quantity of fluid catches the first quantity of fluid thereby forming a single ligament of fluid prior to contacting the substrate.

BRIEF DESCRIPTION OF THE DRAWINGS

The accompanying drawings illustrate various embodiments of the present method and system and are a part of the specification. The illustrated embodiments are merely examples of the present invention and do not limit the scope of the disclosure.

Throughout the drawings, identical reference numbers designate similar, but not necessarily identical, elements.

DETAILED DESCRIPTION

A method and apparatus for dispensing a single ligament of fluid from an inkjet dispenser is described herein. More specifically, a method is described for forming a single ligament of fluid using a piezoelectric or a thermal inkjet dispenser by adjusting the inkjet architecture, drive waveform, pulse spacing, and/or material properties.

As used in this specification and in the appended claims, the term "ligament" is meant to be understood broadly as any united or substantially continuous flow of dispensed fluid. Additionally, the term "head" is meant to be understood as the leading member of an ejected unit of fluid. Similarly, the term "tail" is meant to refer to the trailing portion or end of an ejected quantity of fluid.

In the following description, for purposes of explanation, numerous specific details are set forth in order to provide a thorough understanding of the present system and method for forming a single ligament of fluid. It will be apparent, however, to one skilled in the art that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
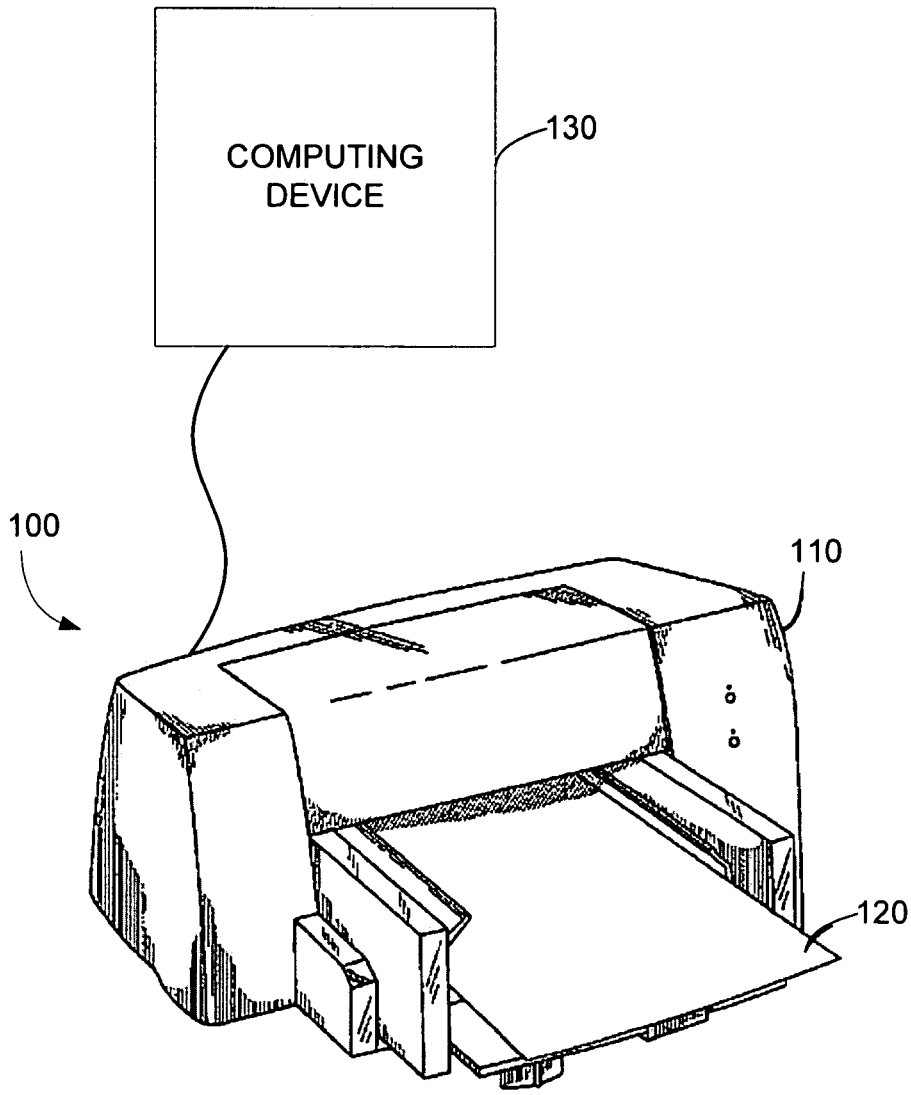
FIG. 1 is a perspective view of a printing system that may be used to implement exemplary embodiments of the present system and method.

FIG. 1 illustrates an inkjet printer (100) configured to incorporate the present single ligament fluid dispensing method in the production of two-dimensional characters according to one exemplary embodiment. As show in FIG. 1, an inkjet printer (100) may include a housing (110) and a print medium (120) disposed on the housing (110). The housing (110) of the inkjet printer (100) illustrated in FIG. 1 may be any shape or size sufficient to house an inkjet dispenser and any associated hardware necessary to perform the present material dispensing method. The housing (110)

may contain one or more dispensers, print medium positioning rollers or belts, servo mechanisms, and/or computing devices.

The inkjet printer (100) may receive a print job from a communicatively coupled computing device (130) wherein the print job includes a digital description of a desired image. The print job may be converted into motion and dispensing commands that may then be used by the inkjet printer (100) to deposit image forming fluid on the print medium (120) to form a desired image. The method described herein may be applied by any inkjet dispenser incorporated by the inkjet printer illustrated in FIG. 1 when dispensing image forming fluid. The inkjet dispenser employed by the inkjet printer (100) to perform the present method may be any inkjet capable of performing print on demand applications including, but in no way limited to, thermally activated inkjet dispensers, mechanically activated inkjet dispensers, electrically activated inkjet dispensers, magnetically activated dispensers, and/or piezoelectrically activated dispensers.

Figure 2:
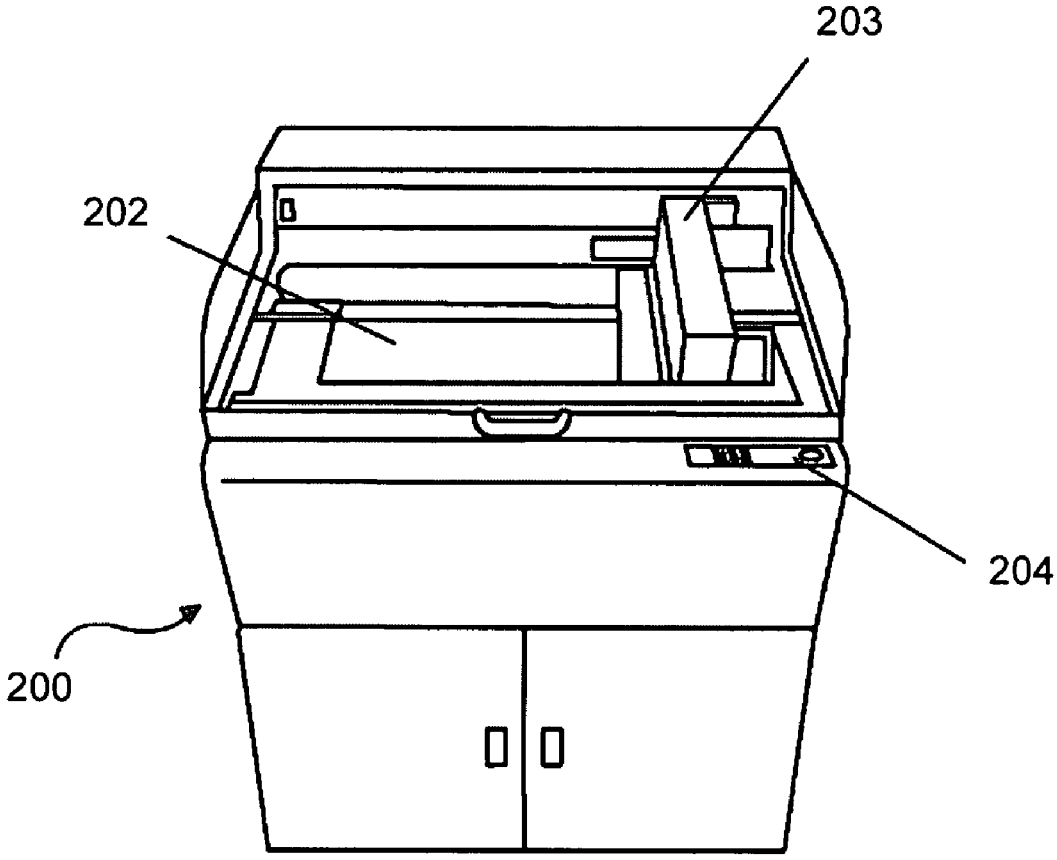
FIG. 2 is a perspective view of a solid freeform fabrication system that may be used to implement exemplary embodiments of the present system and method.

Referring now to FIG. 2, a solid freeform fabrication system (200) that may incorporate the present single ligament fluid dispensing method is illustrated. As shown in FIG. 2, a solid freeform fabrication system may include a fabrication bin (202), a moveable stage (203), and a display panel (204) including a number of controls and displays.

The fabrication bin (202) shown in FIG. 2 may be configured to receive and facilitate the building of a desired three-dimensional object on a substrate. The building of the desired three-dimensional object may require the deposition of build material as well as a support material. Build or support material may include, but is in no way limited to, polymers, wax, or other similar meltable materials or appropriate combinations thereof. While the solid freeform fabrication system (200) illustrated in FIG. 2 is shown as a single, stand-alone, self-contained freeform fabrication system, the present single ligament fluid dispensing methods may be incorporated into any freeform fabrication system that utilizes drop on demand inkjet type dispensers regardless of the structure or configuration of the freeform fabrication system. Moreover, the present single ligament fluid dispensing methods may be incorporated into any system that uses an inkjet dispenser to selectively deposit fluid in a continuous fashion. Inkjet dispensers may incorporate the present single ligament dispensing methods when forming, by way of example only, two dimensional images, three-dimensional objects, or circuitry and circuitry components including, but in no way limited to, transistors, traces, capacitors, resistors, antennae, displays, and/or radio frequency identification tags. When forming electrical components, the fluid may be, but is in no way limited to, gate dielectrics such as BenzoCycloButane (BCB), polysiloxane, polyaniline, and/or polymethyl methacrylate (PMMA); semiconductors such as pentacene, polythiophene, and/or the combination of polyfluorene and MEH-PPV (poly[2-methoxy-5-(2'-ethyl-hexyloxy)]-p-phenylene-vinylene); and inorganic and polymeric conductors such as polyaniline (e.g., blended with polyethylene, etc.), and/or polythiophene.

The moveable stage (203) of the solid freeform fabrication system (200) illustrated in FIG. 2 is a moveable dispenser that may include a number of inkjet dispensers configured to dispense build or structural material. The moveable stage (203) may be controlled by a computing device (not shown) and may be controllably moved by, for example, a shaft system, a belt system, a chain system, etc. As the moveable stage (203) operates, the display panel (204) may inform a user of operating conditions as well as provide the user with a user interface. As a desired three-dimensional object is formed, a computing device may send data instructing the solid freeform fabrication system (200) to controllably position the moveable stage (203) and direct one or more dispensers to controllably eject fluid at predetermined locations within the fabrication bin (202). One or more of the inkjet dispensers used by the solid freeform fabrication system (200) may be a thermal inkjet dispenser configured to perform the present single ligament fluid dispensing method. For ease of explanation only, the present method will be described below with reference to FIGS. 3A to 5D in the context of a thermal inkjet dispenser being incorporated into a solid freeform fabrication device similar to that illustrated in FIG. 2.

Figure 3A:
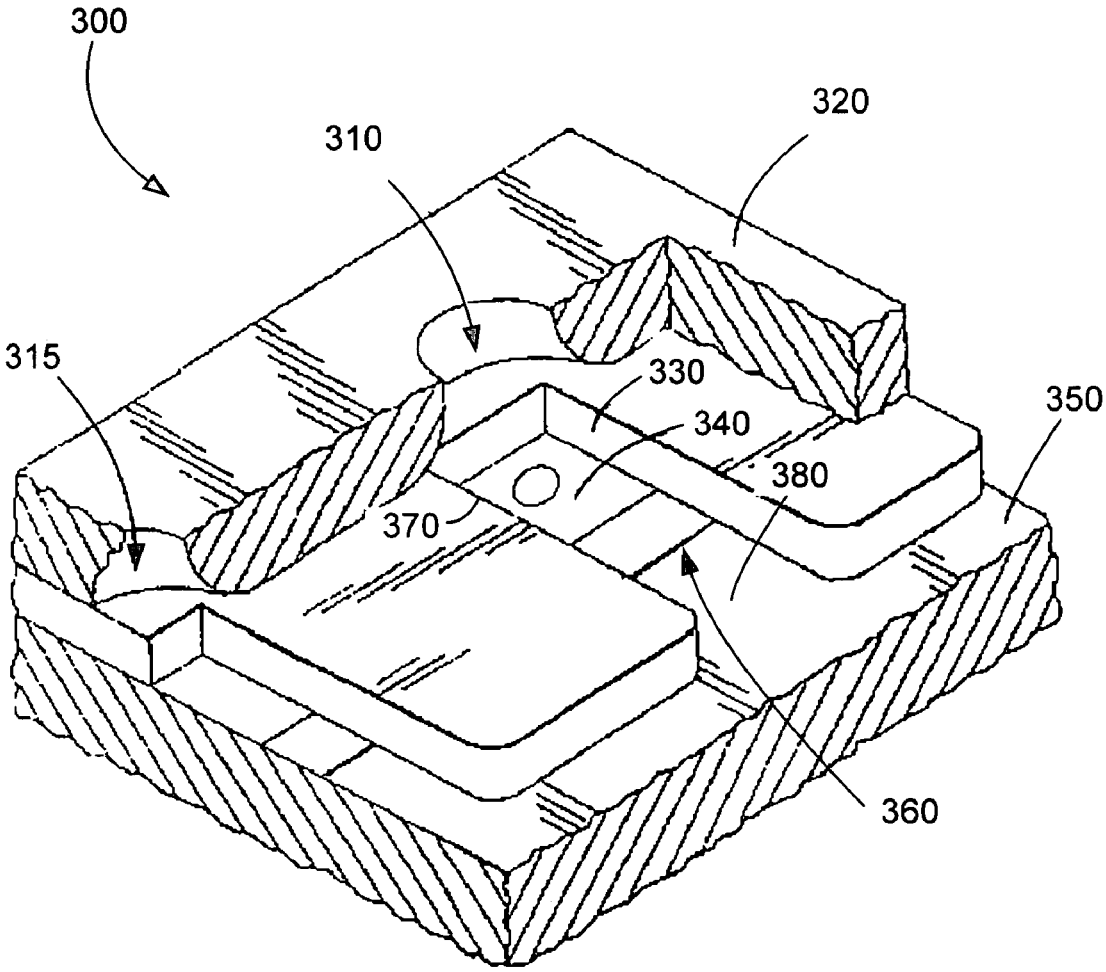
FIG. 3A is a sectioned isometric view of a thermal inkjet dispenser that may perform the present method according to one exemplary embodiment.

FIG. 3A illustrates a sectioned isometric view of a thermal inkjet dispenser (300) that may perform one exemplary embodiment of the present single ligament dispensing method. As shown in FIG. 3A, a thermal inkjet dispenser (300) configured to perform the present method may include a material firing chamber (360) and an orifice (310) associated with the material firing chamber (360). A portion of a second orifice (315) associated with another material firing chamber is also shown in FIG. 3A. The present system and method may be incorporated by a thermal inkjet dispenser (300) having either a single orifice or multiple orifices arranged in a predetermined pattern on an orifice plate (320). During operation, fluid may be supplied to the firing chamber (360) through a chamber inlet (380) configured to replenish fluid which has been expelled from the orifice (310) as a result of vaporizable components of the fluid being vaporized by localized heating from a heating structure (340). The material firing chamber (360) is bounded by walls created by an orifice plate (320), a layered silicon substrate (350), and firing chamber walls (370, 330).

Figure 3B:
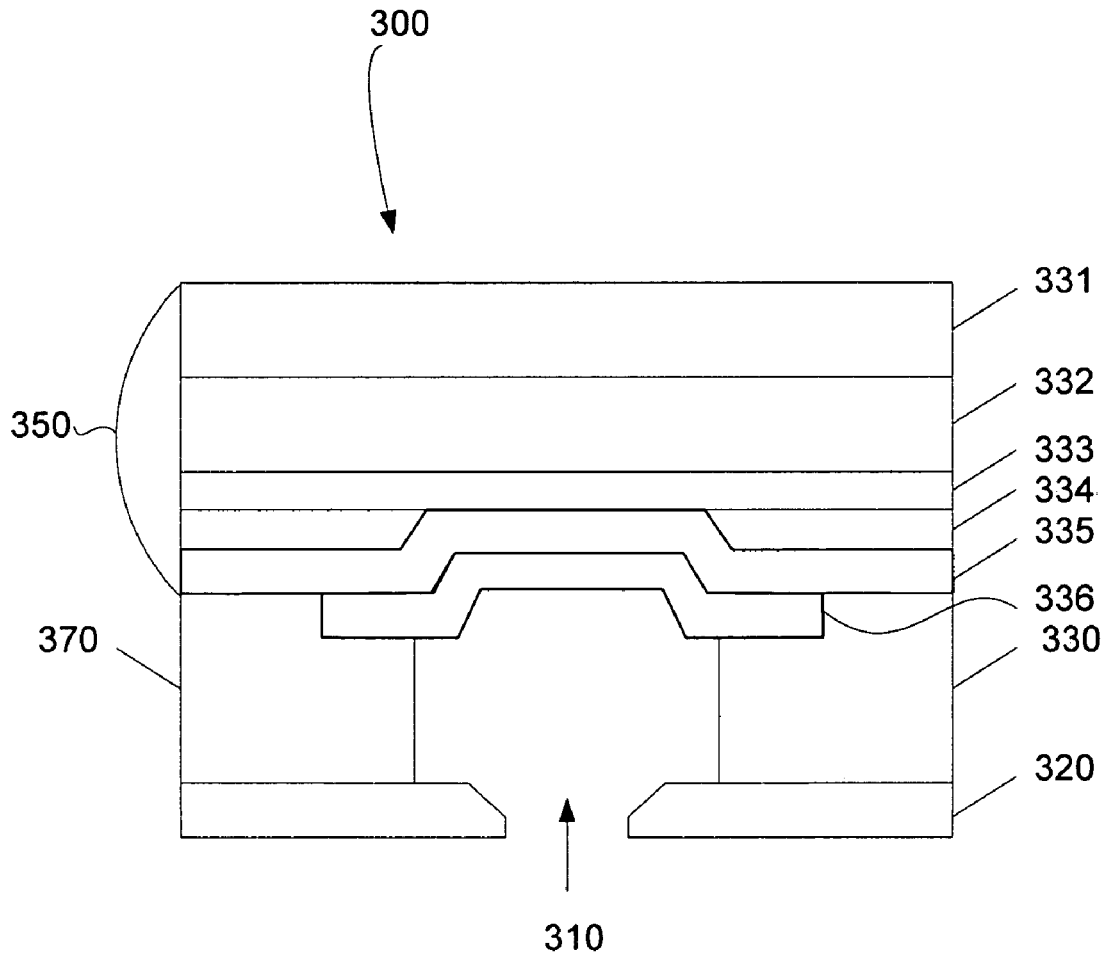
FIG. 3B is a cross-sectional view of a thermal inkjet dispenser according to one exemplary embodiment.

FIG. 3B is a cross-section of the material firing chamber (360) taken through the heating structure (340) to further illustrate the components of a thermal inkjet dispenser. The silicon substrate (350) forming the base of the thermal inkjet dispenser (300) has been expanded in FIG. 3B to enhance the features of its construction. It is assumed in this view that during operation the firing chamber contains ink or another desired fluid and that fluid, vapor, and air interfaces are present. As shown in FIG. 3B, the base of the silicon substrate (350), a p-type silicon volume (331), is covered with a thermal field oxide and chemical vapor deposited $SiO_2$ as the under layer (332). A layer (333) of tantalum aluminum (TaAl) is deposited by conventional methods on the surface of the base and, because it is of a relatively high electrical resistance, forms a resistor layer. A conductor layer (334) of aluminum (Al) is then selectively deposited on the TaAl layer (333) by means of photolithographic masking and developing, leaving open areas of TaAl. The high resistance of the TaAl layer (333) is effectively shorted by the Al layer (334) except in the open areas because of the relatively low electrical resistance of the Al layer (334). The result is a resistor area capable of transferring heat produced from electrical resistance heating of the TaAl layer (333) in this open area for the purpose of vaporizing fluid.

The areas below the resistor should be capable of withstanding thermal extremes, mechanical assault, and chemical attack which result from the rapid vaporization of fluid and subsequent collapse of a vapor bubble. Accordingly, a passivating layer (335), such as a typical $SiN_x$ compound, may be deposited over the structure. Further, a cavitation barrier (336) of tantalum (Ta) may be deposited over and selectively etched from the passivation layer (335) in the material firing chamber to protect against impact created by a collapsing bubble. The cavitation barrier (336) along with the chamber walls (330, 370) and the orifice plate (320) define the material firing chamber (360; FIG. 3A).

As discussed above, the dispenser (300) may be configured to selectively dispense a single ligament of fluid. Accordingly, the thermal inkjet architecture, the drive waveform produced by the thermal inkjet, the pulse spacing of the thermal inkjet, and/or the material properties may be adjusted as explained below.

Exemplary Implementation and Operation

Figure 4:
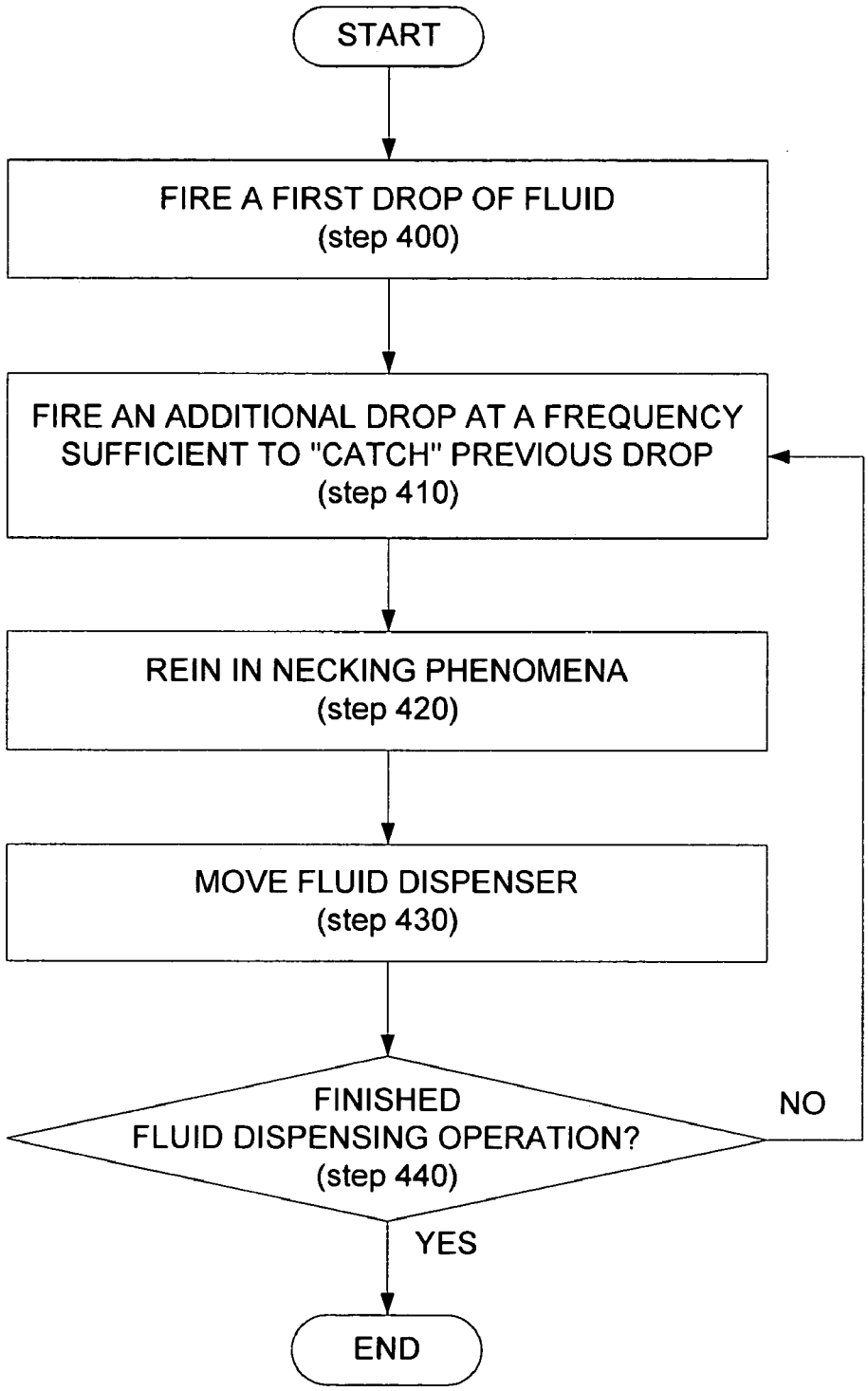
FIG. 4 is a flow chart illustrating a method for dispensing a single ligament fluid according to one exemplary embodiment.

FIG. 4 is a flow chart illustrating the present single ligament fluid dispensing method according to one exemplary embodiment. As illustrated in FIG. 4, the present method may begin by firing a first quantity (step 400) of desired fluid from the thermal inkjet dispenser. Once the first quantity of a desired fluid has been fired (step 400), an additional quantity of fluid may be fired at a frequency sufficient to catch the previous quantity of fluid (step 410). Once the multiple quantities of fluid have been fired from the thermal dispenser and form a single ligament of fluid, the necking phenomena may be reined in to prevent necking and separation of the newly formed single ligament (step 420) into separate ligaments. When one or multiple quantities of fluid have been fired, or simultaneously with the firing of quantities of fluid, the dispenser may be controllably moved and a computing device may then determine whether the fluid dispensing operation is complete (step 440). If the fluid dispensing operation is complete (YES, step 440), no further quantities of fluid are fired. However, if the fluid dispensing operation is not complete (NO, step 440) as determined by the computing device, the thermal inkjet dispenser may again fire an additional quantity of fluid at a frequency sufficient to catch the previously fired quantity of fluid (step 410) and the process is performed again. Each of the above-mentioned steps will now be explained in detail with reference to FIGS. 5A through 5D.

Figure 5A:
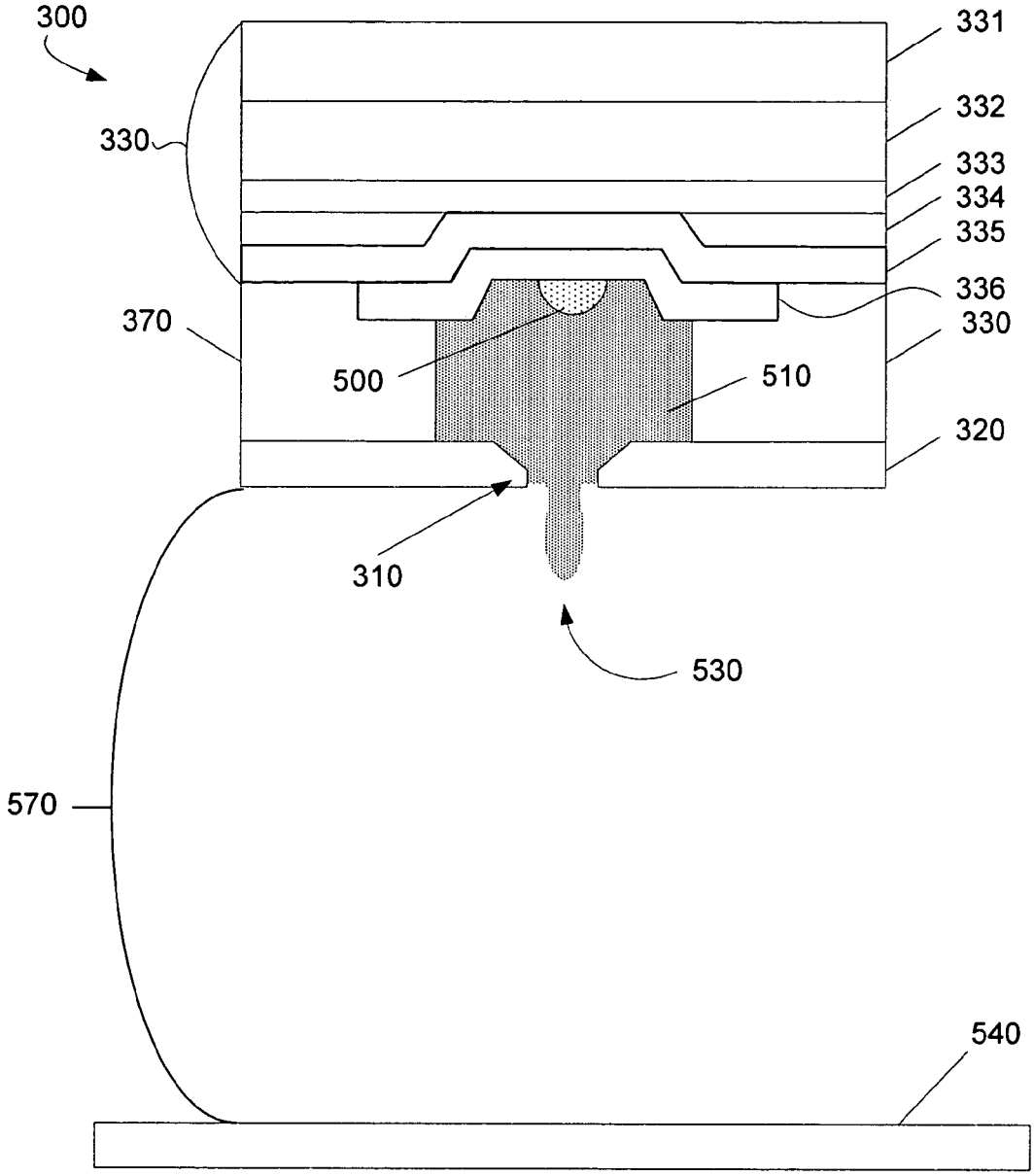
FIGS. 5A, 5B, 5C, and 5D are cross-sectional views illustrating a thermal dispenser performing steps of the present method according to one exemplary embodiment.

As shown in the flow chart of FIG. 4, the present method begins when the thermal inkjet dispenser fires a first quantity of fluid (step 400). FIG. 5A illustrates how a thermal inkjet dispenser (300) similar to that shown in FIG. 3B may controllably fire a first quantity of fluid. Once a computing device controllably signals the solid freeform fabrication apparatus (200; FIG. 2) to fire a quantity of fluid, heat in the TaAl layer (333) of the thermal dispenser is produced through electrical resistance heating. This heat is then transferred through the various layers of the thermal inkjet dispenser (300) to the cavitation baffler (336) where the heat vaporizes locally contacted fluid (510). This vaporization of the fluid (510) is a result of heating the fluid to a temperature which exceeds the boiling paint of the fluid thereby creating a nucleation effect. As the fluid (500) nucleates and expands, it displaces a volume of fluid (510) which is then forced out of the orifice (310) forming a quantity of fluid (530) that may be ejected towards a desired substrate (540).

Once a first quantity of fluid (530) has been fired from the thermal inkjet dispenser, the thermal inkjet dispenser may fire a second quantity of fluid at a frequency sufficient that the head of the second quantity of fluid "catches" the tail of the first quantity of fluid (step 430; FIG. 4). In order for a subsequent quantity of fluid to "catch" a previously fired quantity of fluid, a number of factors must be finely tuned as illustrated in FIG. 5B.

Figure 5B:
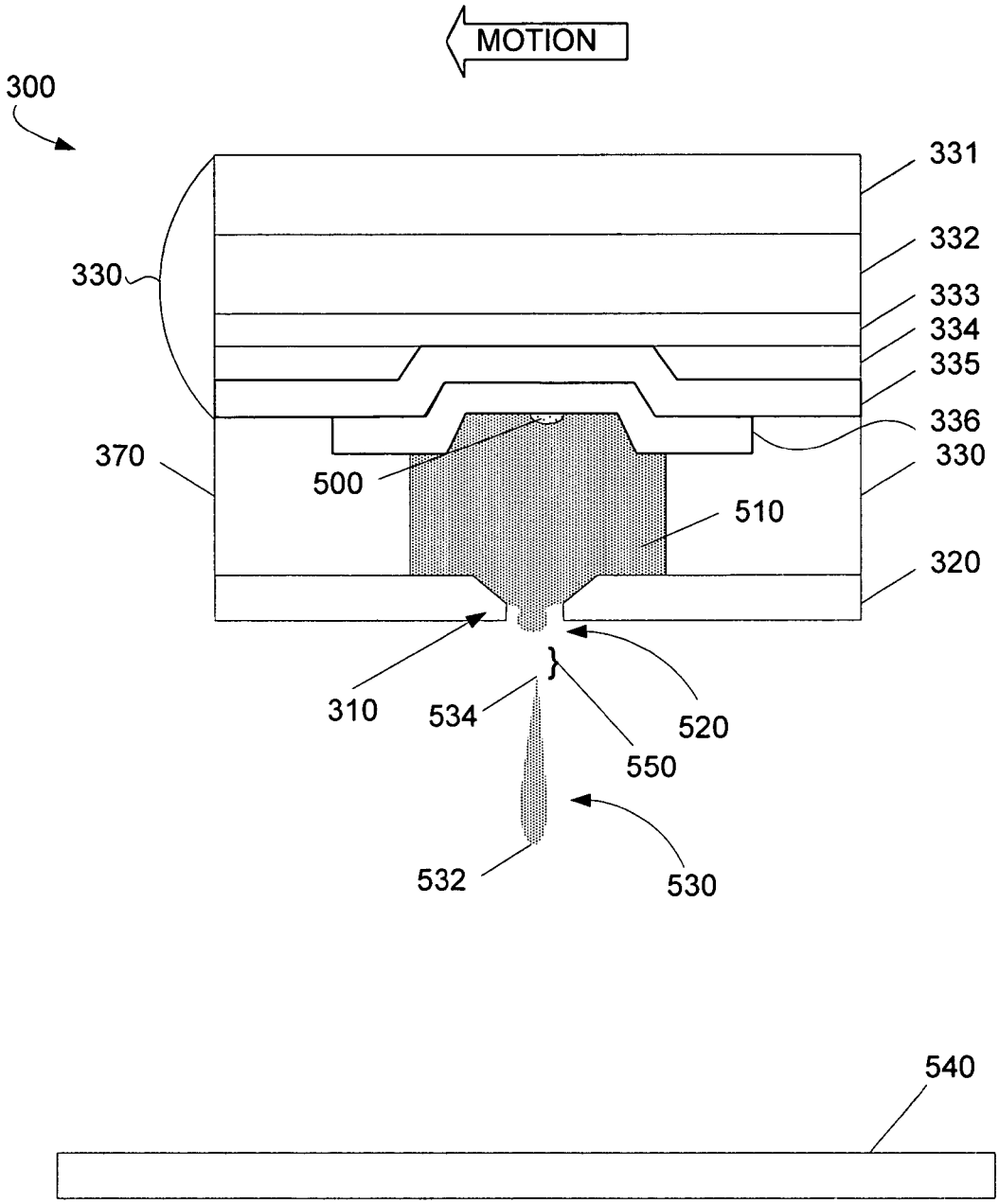

As shown in FIG. 5B, the first quantity of fluid (530) includes a leading head portion (532) and a tail portion (534). Typically there is a gap (550) between the tail portion (534) of an ejected quantity of fluid (530) and the head portion of a subsequently formed quantity of fluid (520). One factor that may be adjusted to aid in the subsequently formed quantity of fluid (520) "catching" the tail of a previously formed quantity of fluid (step 410; FIG. 4) is the firing frequency of subsequent quantities of fluid. Essentially, the firing frequency of subsequent quantities of fluid maybe adjusted in order to minimize the gap (550) created between the tail portion (534) of the ejected quantity of fluid (530) and the head portion of the subsequently formed quantity of fluid (520). However, the frequency of a thermal inkjet dispenser (300) is usually constrained somewhat by the need for a desired flow rate. Fixing frequencies may be maximized within the range of flow rate constraint in order to facilitate continuous ligament behavior. When a thermal inkjet dispenser operates at higher firing frequencies, continuous ligament behavior is facilitated not only due to the small time between quantities of fluid but also because of chamber refill behavior at these frequencies.

Once the first quantity of fluid (530) has been ejected from the thermal inkjet dispenser (300), the speed of the ejected quantity of fluid (530) generally plateaus off. However, as the first quantity of fluid is ejected towards the desired substrate, a stretching phenomenon occurs. This stretching phenomenon is caused as the tail portion (534) of the first quantity of fluid (530) clings to the orifice region from which it was ejected due to surface tension. This surface tension applies a force upon the tail portion (534) of the first quantity of fluid (530) resulting in the tail portion (534) traveling at a relatively slower velocity than the head portion (532). This relative difference in velocity between the head portion (532) and the tail portion (534) causes the quantity of fluid (530) to stretch out thereby aiding in the formation of a single continuous ligament of fluid.

After a first quantity of fluid (530) has been ejected from a thermal inkjet dispenser (300), the nucleation bubble (500) formed to eject the first quantity of fluid collapses causing a negative pressure. This negative pressure plays a major role in the refill of the material firing chamber, especially at higher frequencies. When operating at higher firing frequencies, the amount of liquid present in the material firing chamber during subsequent firing events is less than it would be at steady state (such as when the first quantity of fluid was ejected) because the refill of the material firing chamber has not had an opportunity to reach steady state prior to subsequent firing events. Consequently, subsequent nucleation bubbles (500) act on smaller fluid volumes than the first quantity of fluid, causing the velocity of subsequent quantities of fluid to be higher than previous quantities of fluid as they leave the orifice (310). The increase in velocity may not only aid the head portion of a subsequent quantity of fluid (520) in catching the tail portion (534) of a previously ejected quantity of fluid (530), but it may also stretch out the length of the subsequent quantity of fluid (520).

Moreover, other factors in addition to firing frequency may be adjusted to slow down the refill of the material firing chamber thereby decreasing the amount of fluid being acted upon by the nucleation bubble. Some factors that may be adjusted include, but are in no way limited to, increasing the backpressure, increasing the viscosity of the fluid (thereby slowing its flow into the firing chamber), decreasing orifice impedance, and/or increasing chamber inlet impedance. These or any other factors that tend to slow down the refill of the material firing chamber may be adjusted to accentuate the increased speed and length of subsequent quantities of fluid ejected from a partially filled material firing chamber.

Figure 5C:
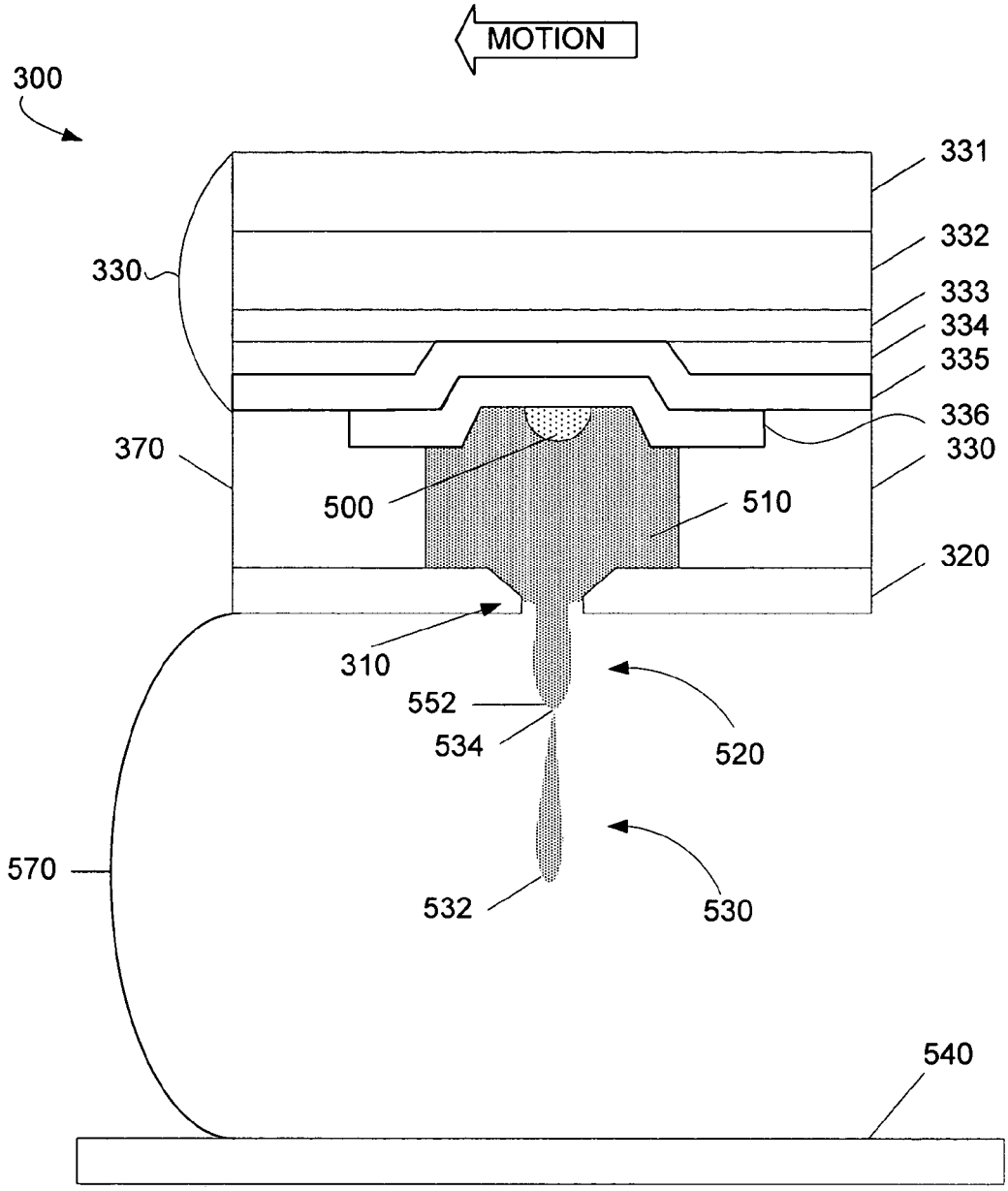
Figure 5D:
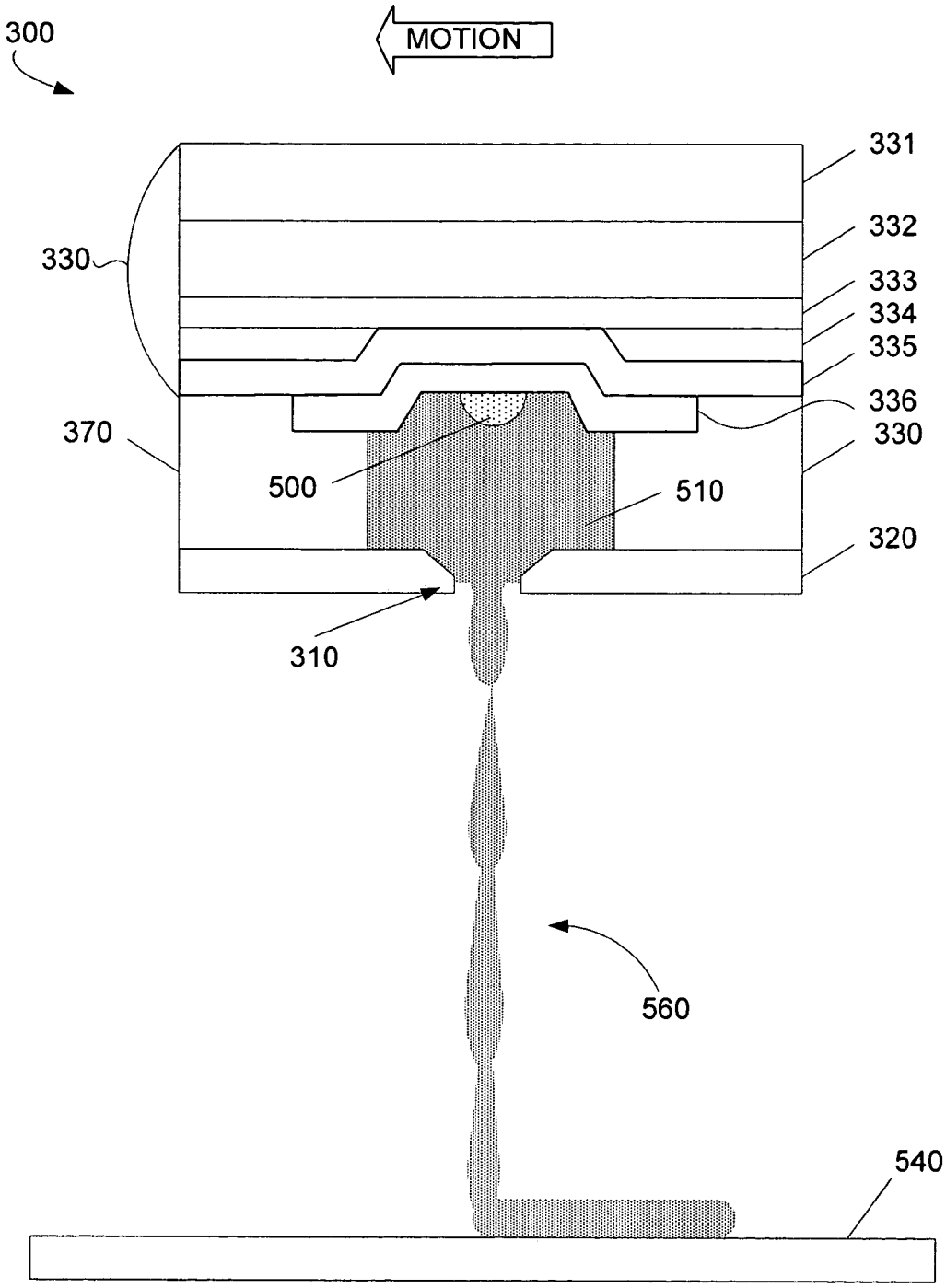

Once two or more quantities of material have been fired from the thermal inkjet material dispenser and the gap between the tail portion (534) of previously ejected quantities of material and the head portion (552) of subsequently ejected quantities of material (520) has been eliminated as shown in FIG. 5C, the individual quantities of material may form a single ligament of fluid (560; FIG. 5D) translating toward a desired substrate (540) as shown in FIG. 5D. Both during the ejection of quantities of material and after a single ligament of fluid (560) has been formed out of individual quantities of material, one concern is to maintain the material in a single ligament of fluid by reining in the necking phenomenon (step 420; FIG. 4). Generally, single ligaments of fluid have a tendency to break up in flight due to the growth of surface capillary waves. This phenomenon, often called the Rayleigh instability, results from the surface tension overcoming inertial effects at the troughs of surface capillary waves. In order to retard capillary breakup of the single ligament of fluid, the material properties may be adjusted. The relative rate of the necking (susceptibility to a reduction of the cross-sectional area of a material in a localized area) depends on the ratio of the surface tension and viscosity. Increasing the fluid viscosity and decreasing the surface tension of the fluid may decrease the necking rate and may subsequently reduce the likelihood of capillary breakup. Surface tension of the fluid material (510) determines the force squeezing the fluid material into separate segments. Similarly, the viscosity of the fluid material (510) determines the rate of the fluid material's resistance to the surface tension.

Since typical inkjet devices are designed to emit discrete droplets, the surface tension and viscosity values of the fluid (510) used may be varied to achieve and maintain a single ligament of dispensed fluid. By way of example only, typical thermal inkjet devices configured to emit discrete droplets may utilize a fluid having a nominal viscosity of 1 centipoise (cP). Increasing this value to 2 cP or more extends the length of the ligament while decreasing the likelihood of capillary breakup. The increase in viscosity may be accomplished by selecting a fluid with a high viscosity and/or adjusting the operating temperature of the thermal inkjet dispenser. Moreover, the nominal surface tensions of fluids used are often strongly dependent on applications which set the base fluid's composition. Traditional methods incorporated fluids having surface tensions ranging between 50 dyne/cm to 25 dyne/cm. High surface tensions tend to pull the tail portion of ejected droplets towards the head portions in an effort to form spherical fluid droplets. However, by decreasing the surface tension of the fluids used when performing the present method, the tendency to shorten the ligament length may be reduced thereby forming longer ligaments and decreasing the necking rate.

Reducing the necking phenomena (step 420; FIG. 4) allows the ejected fluid to remain a single fluid ligament until it is deposited on a desired substrate (540). Simultaneous with the ejection of fluid and the deposition of the single fluid ligament on a desired substrate (540), the thermal inkjet print head (300) may be translated (step 430; FIG. 4) as indicated by the arrow in FIG. 5D to selectively deposit the fluid (510). A computing device (130; FIG. 1) may be employed to issue commands to a number of servo devices (not shown) that may selectively position the thermal inkjet dispenser (300) to deposit fluid in designated locations on the substrate (540). Additionally, the advantages of dispensing a single ligament of fluid allow the thermal inkjet dispenser to operate at distances as close as ¼ millimeter from the desired printable medium.

Returning again to FIG. 4, after each quantity of fluid is ejected from the thermal inkjet dispenser (step 410), a computing device (not shown) determines whether the fluid dispensing process is complete (step 440). According to one exemplary embodiment, if the computing device determines that the fluid dispensing process is complete (YES; step 440), the thermal inkjet dispenser ceases to fire quantities of fluid (510; FIG. 5D). However, if the computing device determines that the fluid dispensing process is not complete (NO; step 440), then the computing device may cause the thermal inkjet dispenser to fire an additional quantity of fluid at a frequency sufficient to "catch" the previously fired quantity of fluid (step 410) and the process illustrated in FIG. 4 begins again.

While the above-mentioned method has been explained in the context of a thermal inkjet dispenser incorporated in a solid freeform fabrication apparatus, the present method may also be incorporated into any number of two or three-dimensional printing devices including, but in no way limited to inkjet printers, copy machines, scanners, facsimile machines, etc. Additionally, the present method may be readily incorporated into any number of fabrication devices that selectively dispense fluid to fabricate components including, but in no way limited to circuitry, or circuit components such as transistors, traces, capacitors, resistors, antennae, displays, radiofrequency identification tags, etc. Moreover, while the present method was illustrated in the context of a thermal inkjet dispenser type fluid dispenser, the present method may be incorporated into any number of selective deposition dispensers including, but in no way limited to, thermally activated inkjet dispensers, mechanically activated inkjet dispensers, electrically activated inkjet dispensers, magnetically activated dispensers, and/or piezoelectrically activated dispensers.

ALTERNATIVE EMBODIMENTS

Figure 6:
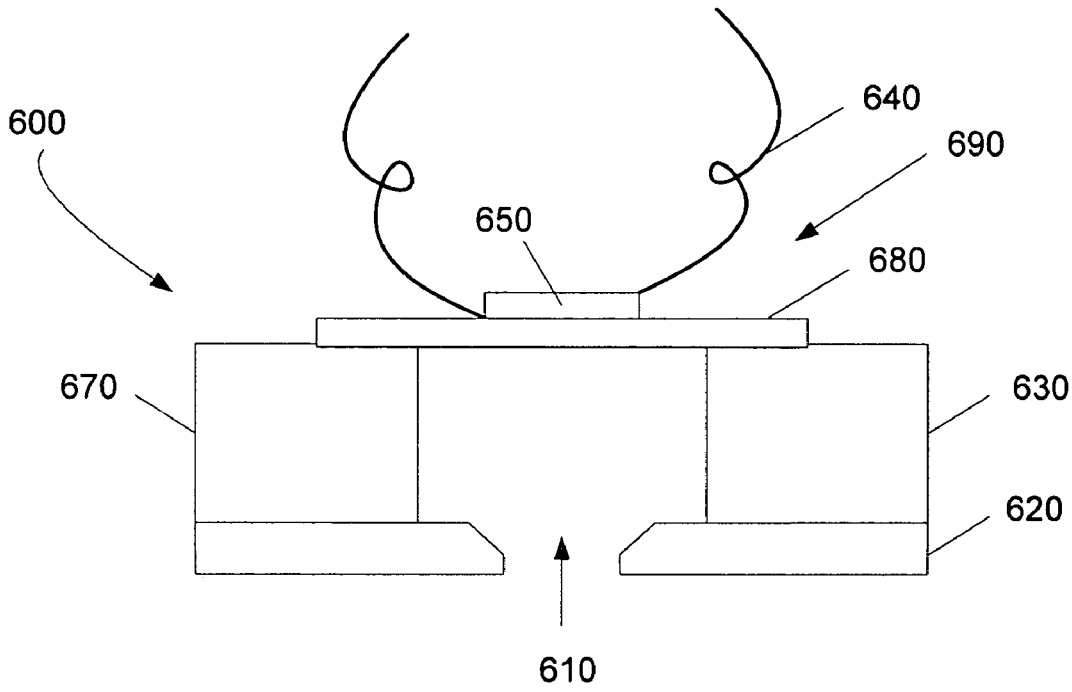
FIG. 6 is a simplistic cross-sectional view of a piezoelectric dispenser according to one exemplary embodiment.

According to one alternative embodiment illustrated in FIG. 6, the present single ligament fluid dispensing method may be incorporated by a piezoelectric inkjet dispenser. As shown in FIG. 6, a piezoelectric inkjet dispenser (600) may include a piezoelectric transducer (650), such as a piezoceramic, electrically coupled to an electrical source (not shown) by a number of wire leads (640). As shown in FIG. 6, the piezoelectric transducer (650) may be coupled to a flexible diaphragm (680) forming a controllable actuator (690). The controllable actuator (690) is coupled to a number of chamber walls (630, 670) and an orifice plate (620) having an orifice (610) to define a material firing chamber. While the piezoelectric dispenser illustrated in FIG. 6 shows the controllable actuator (690) positioned opposite the material orifice (610), the present method may be applied to any piezoelectric dispenser configuration including, but in no way limited to, a squeeze deformation mode dispenser, a bend deformation mode dispenser, a push deformation mode dispenser, or a shear deformation mode dispenser. Moreover, the controllable actuator (690) may be disposed on a side wall or in a flextensional transducer configuration wherein a flexible membrane serves both as the controllable actuator (690) and as the orifice plate (620).

Figure 7:
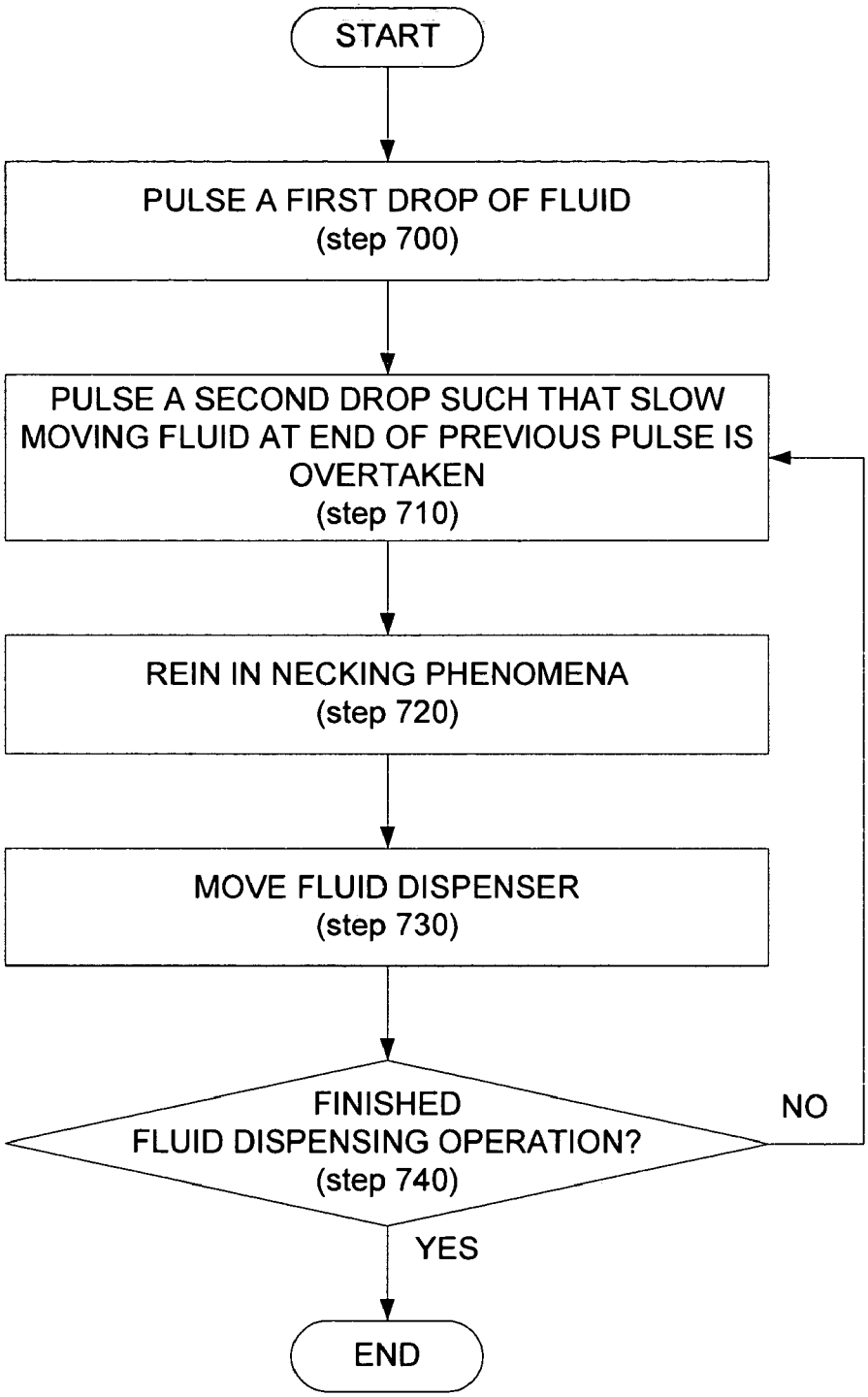
FIG. 7 is a flow chart illustrating a method for dispensing a single ligament fluid from a piezoelectric dispenser according to one exemplary embodiment.

A method for dispensing a single ligament of fluid from a piezoelectric inkjet dispenser is illustrated in FIG. 7. Similar to the method employed by the thermal inkjet dispenser explained above, the piezoelectric inkjet dispenser (600; FIG. 6) begins the single ligament forming method by pulsing a first quantity of fluid (step 700). Once the first quantity of fluid has been pulsed, a second quantity of fluid may be pulsed in such a manner that the slow moving fluid at the end of the previous quantity of fluid is overtaken (step 710) by the subsequent quantity of fluid prior to its exit from the orifice plate. Once multiple quantities of fluid have been pulsed to form a single fluid ligament, the necking phenomena is reined in to prevent subsequent separation of the single fluid ligament (step 720). As the piezoelectric inkjet dispenser continues to dispense the fluid, the piezoelectric inkjet dispenser may be moved (step 730) in order to selectively distribute the fluid. If the system determines, upon deposition of the fluid, that the fluid deposition process is complete (YES, step 740), the piezoelectric inkjet dispenser stops pulsing fluid. If, however, the system determines that the fluid dispensing operation is not finished (NO, step 740), another quantity of fluid may be pulsed such that the quantity of fluid overtakes the slow moving fluid at the end of the previously pulsed quantity of fluid (step 710) and the process begins again. The present method will now be briefly explained with reference to FIGS. 8A through 8D.

Figure 8A:
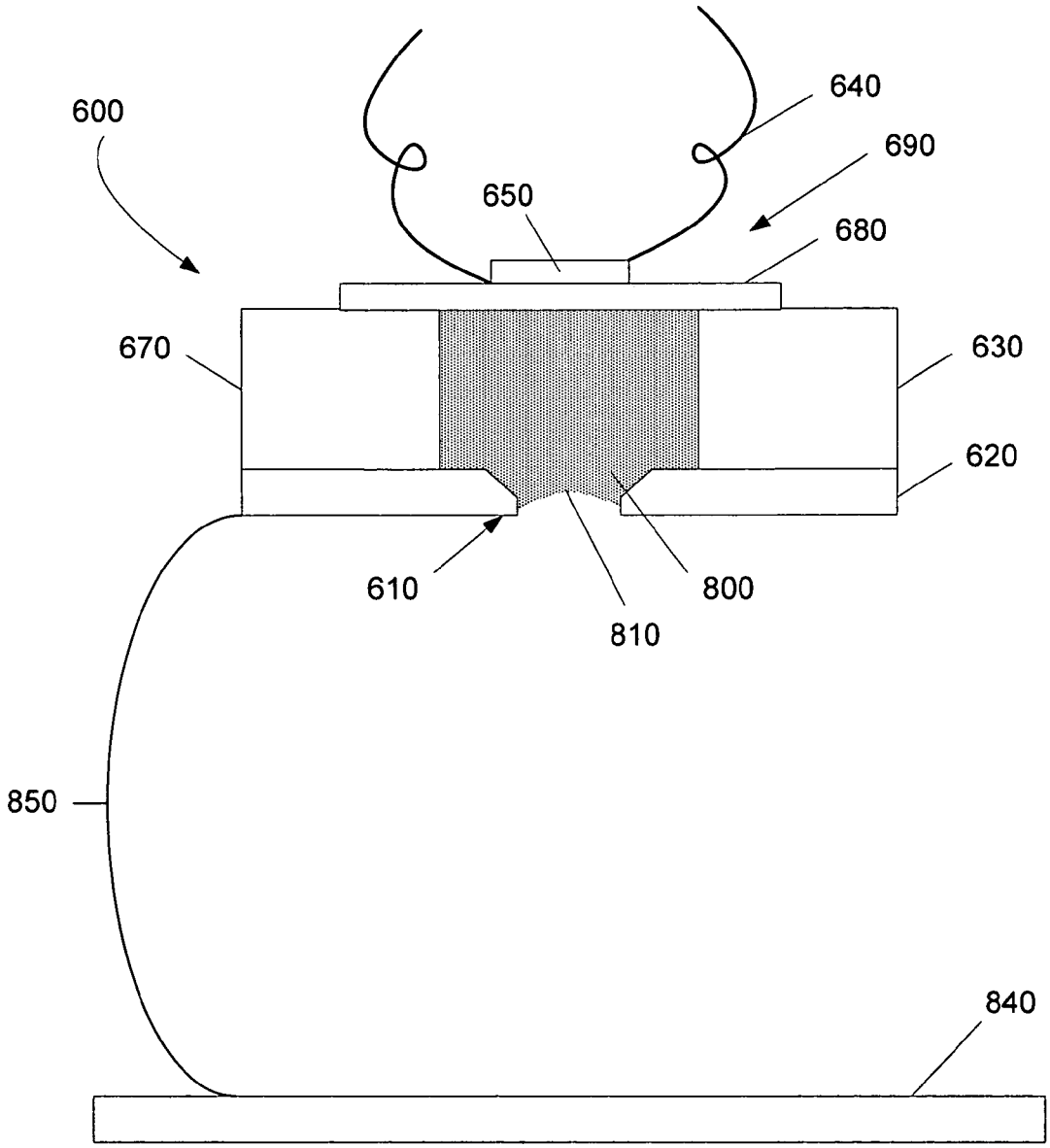
FIGS. 8A, 8B, 8C, 8D, and 8E are cross-sectional views illustrating a piezoelectric dispenser performing steps of the present method according to one exemplary embodiment.
Figure 8B:
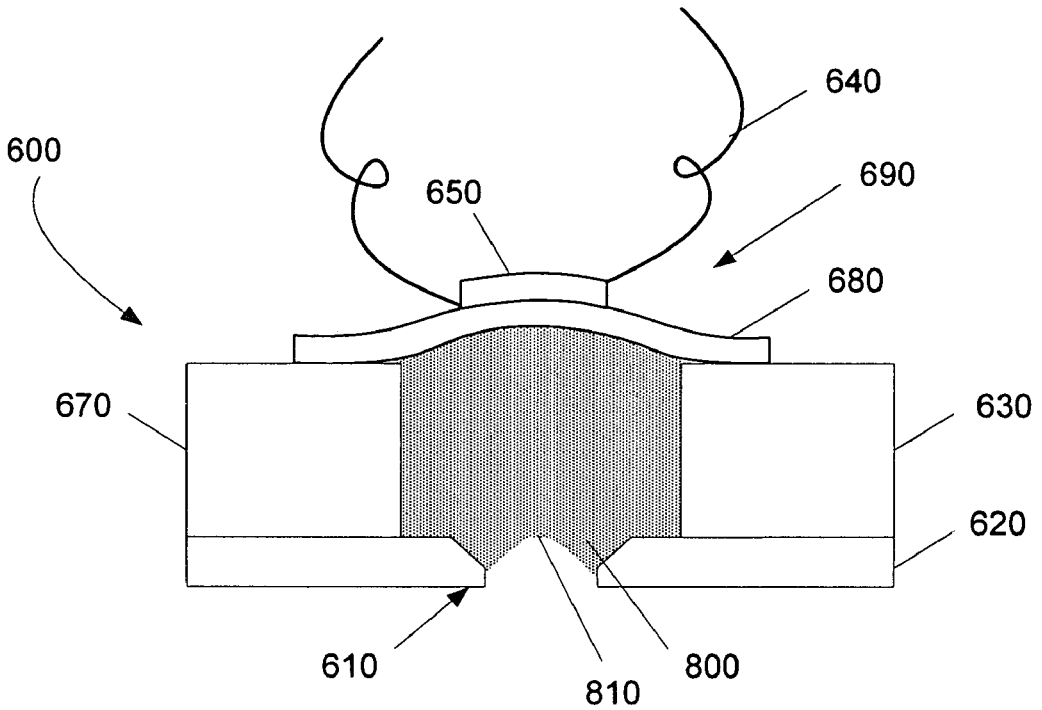
Figure 8B:
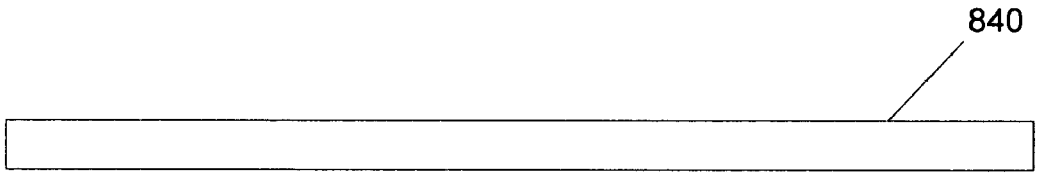

As shown in FIG. 8A, a piezoelectric inkjet dispenser (600) may be placed over a desired substrate (840) or print medium. The distance (850) between the piezoelectric inkjet dispenser (600) and the desired substrate (840) according to one exemplary embodiment is less than 3.5 millimeters. The material firing chamber illustrated in FIG. 8A may initially be filled with a fluid (800) in anticipation of being deposited on the desired printable medium (840). As shown in FIG. 8A, the fluid (800) forms a meniscus (810) at the material orifice (610). When the process illustrated in FIG. 7 is initiated, the piezoelectric inkjet dispenser (600) begins to pulse a first quantity of fluid (step 700; FIG. 7) from the material firing chamber as illustrated in FIG. 8B. As shown in FIG. 8B, when a first quantity of fluid is desired, a number of electrical signals are selectively transmitted to the controllable actuator (690) through the wire leads (640). Once the electrical signal is transmitted to the piezoelectric transducer (650), the transducer is displaced causing a reduction in pressure in the firing chamber. The reduction in pressure causes a retraction of the meniscus (810) as shown in FIG. 8B.

Figure 8C:
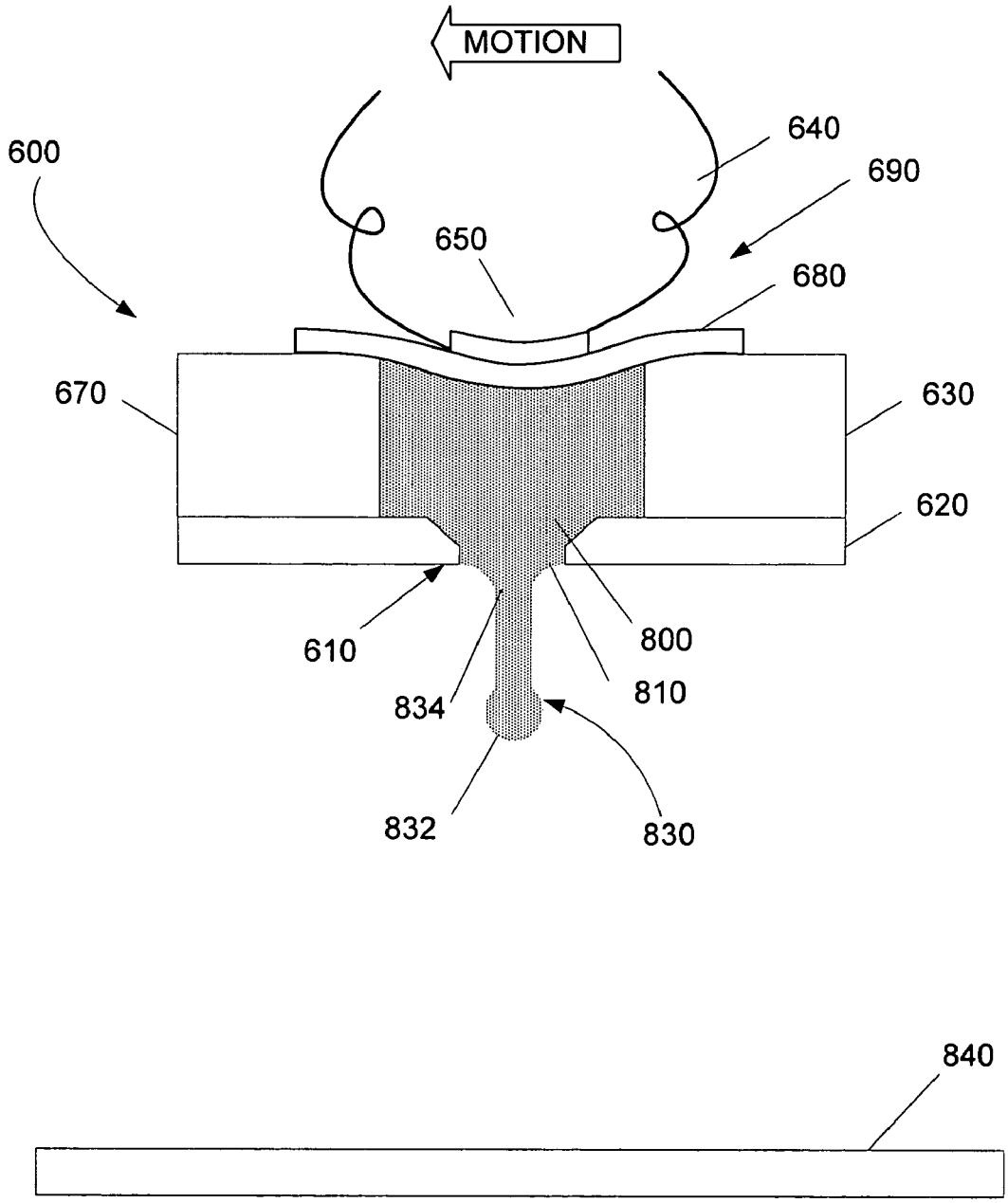

Once the meniscus (810) is retracted as shown in FIG. 8B, another electrical signal causes the controllable actuator (690) to reverse its displacement causing pressure surge in the material firing chamber. As shown in FIG. 8C, the surge in the pressure within the material firing chamber causes the meniscus (810) to bulge resulting in an ejection of a quantity (830) of fluid (800) towards a desired substrate (840). The quantity (830) of fluid (800) includes a leading edge (832) and a trailing portion (834).

Figure 8D:
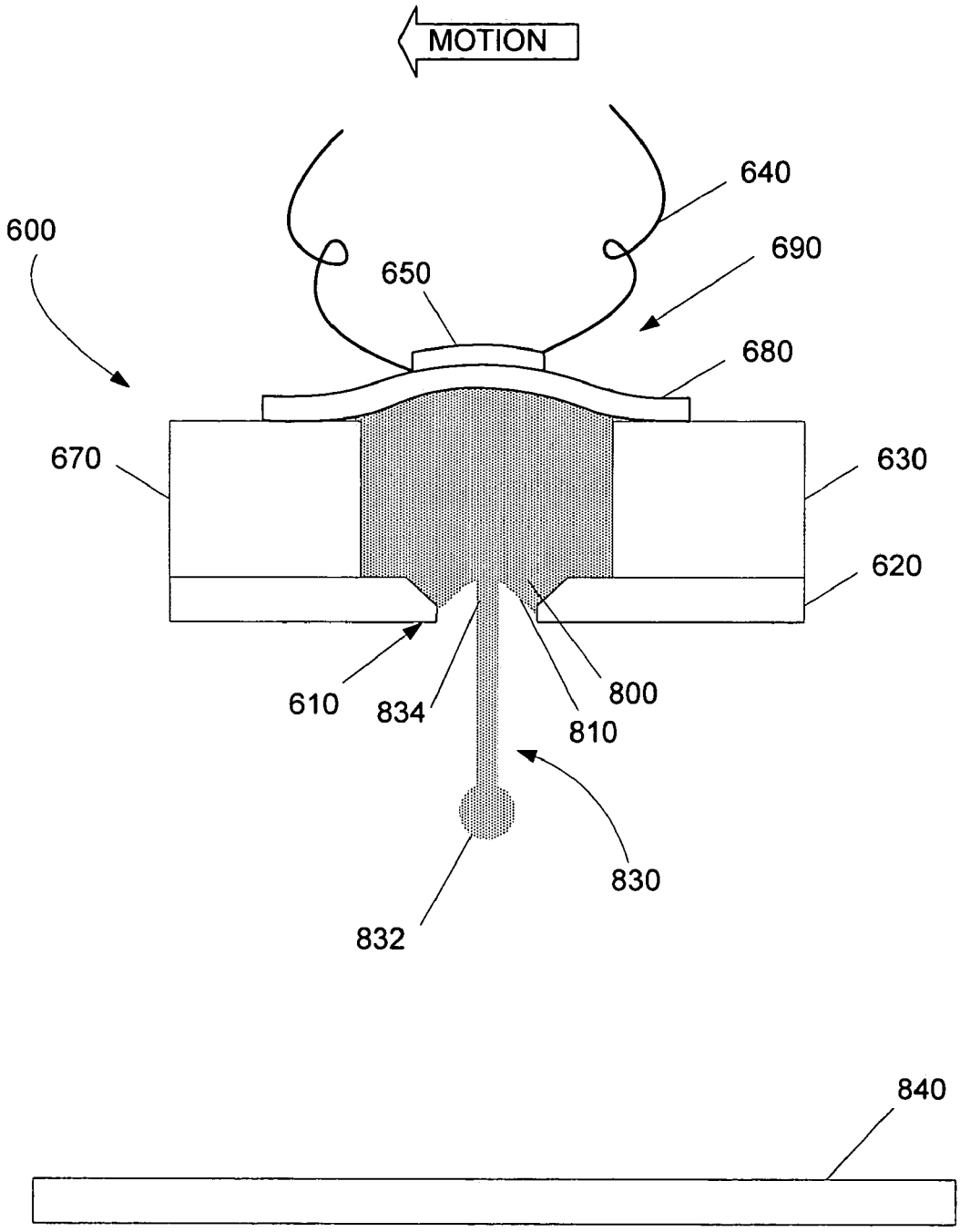

Once the first quantity of fluid (830) has been pulsed towards the desired print medium, another electrical signal causes the controllable actuator (690) to retract as shown in FIG. 8D. The controllable actuator (690) is gently retracted creating a negative pressure in the material firing chamber. The negative pressure caused by the retraction of the piezoelectric transducer (650) both pulls fluid into the firing chamber from a material reservoir (not shown) and pulls back somewhat on the first quantity of fluid (830). This negative pressure causes a difference in the relative velocity between the leading edge (832) and the trailing portion (834) of the quantity (830) of fluid (800). The difference in relative velocities has a stretching effect on the quantity (830) of fluid (800) as shown in FIG. 8D.

Figure 8E:
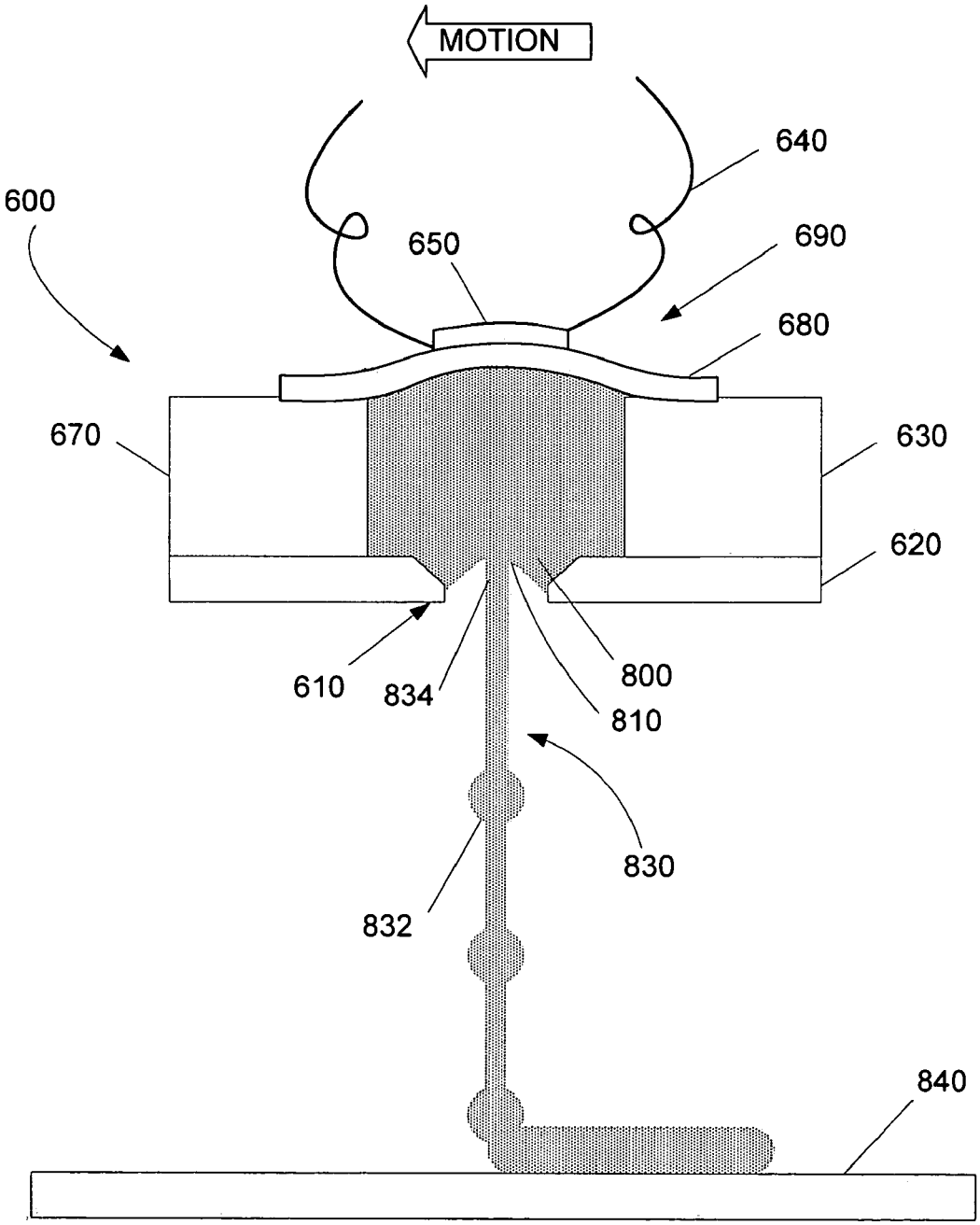

Once retracted, the controllable actuator (690) may pulse subsequent quantities of fluid. As shown in FIG. 8E, subsequent quantities of fluid may be pulsed such that no gap occurs between the trailing portion (834) of the ejected quantity (830) and the leading edge (832) of the next quantity of fluid. The elimination of the gap may be facilitated through any combination of adjusting the temporal shape of the driving force (actuator displacement) as described above, increasing the fluid viscosity, reducing the impedance of the chamber inlet to increase fluid flow into the firing chamber, and/or adjusting the time between pressure changing pulsations (frequency of pulsations). Consequently, a single ligament of pulsed fluid may be formed as illustrated in FIG. 8E. Once pulsed, the leading edge of fluid from the second pressurization will move closer to the leading edge (832) of the first pressurization until its velocity drops to the same velocity as the first pulsation. The velocity of each quantity of pulsed fluid will be reduced as it passes through the material orifice (610) and through the negative pressure created by the retraction of the controllable actuator (690).

Typically, the frequency of pulsations is a constant set by the need for a desired flow rate. One constraint on the frequency of pulsations is the need to refill the material firing chamber. Refill in high frequency devices depends less on the capillary response of the fluid meniscus (810) in the emission orifice (610) than the negative pressure created by retracting the controllable actuator (690). Refill must not be too abrupt or the pressure may drop to a point where the flow in some fluid regions will drop below the minimum required to maintain the ejected fluid in single ligament form. Reduced impedance of the chamber inlet may be adjusted as explained above to reduce the effects of abrupt fill.

Both during and after emission of a quantity of fluid, the necking phenomenon may be reined in to prevent the single ligament from separating into discrete droplets due to Rayleigh instability (step 720; FIG. 7). Increasing the fluid viscosity and decreasing the surface tension of the fluid effectively decreases the necking rate as described above with reference to the thermal inkjet dispenser. By decreasing the surface tension of the pulsed fluid (830), the force tending to squeeze the fluid into separate ligaments is reduced. Similarly, increasing the viscosity of the. pulsed fluid increases the resistance of the fluid to the surface tension. For a typical piezoelectric inkjet dispenser, the nominal fluid viscosity may be 10 cP. Increasing this fluid viscosity to, for purposes of explanation only, between 15 cP to 20 cP extends the length of the ligament as much as 50% thereby increasing the ability of the present method to produce a single fluid ligament. However, the present method may incorporate a piezoelectric inkjet dispenser to produce a single fluid ligament with a fluid having a viscosity as low as 5 cP.

Once a single ligament is being produced, as shown in FIG. 8E, a computing device (not shown) may controllably move the dispenser (step 730). The movement of the dispenser may be selectively performed to deposit the fluid on desired locations of the substrate (840). Two or more pulses of fluid may form the single ligament being deposited on the substrate (840). The advantages of dispensing a single ligament of fluid allow the piezoelectric inkjet dispenser to operate at distances as close as ½ millimeter from the desired printable medium. Moreover, when a dispenser operates at distances closer than ½ millimeter, no bulges occur because the length of a single emission from the dispenser spans the distance between the dispenser and the substrate. Operations of a dispenser at this distance are typically not desirable for two-dimensional printing on paper or some other medium due to the likelihood of impact between the dispenser and the print medium if moisture causes buckling of the print medium. However, in SFF and other industrial applications, these practical constraints may not hold and printing at distances less than ½ millimeter is feasible and contemplated by the present system and method.

Returning again to FIG. 7, after each quantity of fluid is ejected from the piezoelectric inkjet dispenser (step 710) and the piezoelectric inkjet dispenser is moved (step 730), the computing device (not shown) may determine whether the fluid dispensing process is complete (step 740). According to one exemplary embodiment, if the computing device determines that the fluid dispensing process is complete (YES; step 740), the piezoelectric inkjet dispenser (600) may cease to pulse quantities of fluid. However, if the computing device determines that the fluid dispensing process is not complete (NO; step 740), then the computing device may cause the piezoelectric inkjet dispenser (600) to pulse an additional quantity of fluid and the process illustrated in FIG. 7 begins again.

In another alternative embodiment, the present method may be used to dispense a continuous ligament of adhesive on a receiving medium. According to this exemplary embodiment, either a thermal or a piezoelectric inkjet dispenser may be incorporated in an apparatus to dispense a single ligament of adhesive on a receiving medium as explained above.

In conclusion, the present single ligament fluid dispensing system and method effectively allow for the production of smooth edged deposits without the addition of costly steps and dispensers. More specifically, the present system and method permit the use of standard inkjet fluid dispensing devices to produce continuous fluid ligaments by adjusting the emission frequency of the devices as well as adjusting material properties. The resulting single ligament of fluid may then be selectively deposited on a desired substrate without breaking up into individual segments. The properties produced by the deposition of a single ligament of fluid may be advantageous to produce smoother images, to produce continuity between electrical components, and to reduce porosity in SFF objects.

The preceding description has been presented only to illustrate and describe exemplary embodiments of the invention. It is not intended to be exhaustive or to limit the invention to any precise form disclosed. Many modifications and variations are possible in light of the above teaching. It is intended that the scope of the invention be defined by the following claims.

What is claimed is:

1. A method for dispensing a single, continuous ligament of fluid on a substrate with an inkjet dispenser comprising:

ejecting a first quantity of said fluid from said inkjet dispenser towards the substrate;

ejecting subsequent quantities of said fluid from said inkjet dispenser toward said substrate; and moving the inkjet dispenser relative to the substrate;

wherein said subsequent quantities of fluid are ejected from said inkjet dispenser such that said first quantity of said fluid and said subsequent quantities of said fluid form the single, continuous ligament of said fluid on said substrate without breaking up into individual segments; and wherein said ligament consists of a plurality of fluid heads and tails.

2. The method of claim 1, further comprising reducing a necking phenomena of said fluid.

3. The method of claim 2, wherein said reducing a necking phenomena comprises increasing a viscosity of said fluid.

4. The method of claim 2, wherein said reducing a necking phenomena comprises decreasing a surface tension of said fluid.

5. The method of claim 1, wherein said inkjet dispenser is disposed in an inkjet printer configured to form two-dimensional characters.

6. The method of claim 5, wherein said fluid comprises ink.

7. The method of claim 1, wherein said inkjet dispenser is disposed in a solid freeform fabrication apparatus.

8. The method of claim 7, wherein said fluid comprises an object build material.

9. The method of claim 7, wherein said fluid comprises an object support material.

10. The method of claim 1, wherein said inkjet dispenser is disposed in a circuit formation apparatus.

11. The method of claim 10, wherein said fluid comprises one of a conductive circuit build material, a semi-conductive build material, or a dielectric build material.

12. The method of claim 10, wherein said single ligament of fluid contacts said substrate to form a circuit component.

13. The method of claim 12, wherein said circuit component comprises one of a transistor, a trace, a capacitor, a resistor, an antenna, a display, or a radiofrequency identification tag.

14. The method of claim 1, wherein said fluid comprises an adhesive or binder.

15. A method for dispensing a single, continuous ligament of fluid on a substrate from a thermal inkjet dispenser comprising:

ejecting a first quantity of said fluid having a head and a tail from said thermal inkjet dispenser towards the substrate;

ejecting subsequent quantities of said fluid having at least a head from said thermal inkjet dispenser toward said substrate; and moving the thermal inkjet dispenser relative to the substrate;

wherein said subsequent quantities of fluid are ejected from said thermal inkjet dispenser such that said head of each of said subsequent quantities of fluid catches said tail of a preceding quantity of fluid thereby forming the single, continuous ligament of said fluid on said substrate without breaking up into individual segments; and wherein said ligament consists of a plurality of fluid heads and tails.

16. The method of claim 15, further comprising choosing said fluid to have a viscosity above 2 centipoise at an operating temperature of said inkjet dispenser.

17. The method of claim 15, further comprising choosing said fluid to have a surface tension below 30 dyne/centimeter.

18. A method for dispensing a single, continuous ligament of fluid on a substrate with an inkjet dispenser comprising:

ejecting a first quantity of said fluid from said inkjet dispenser towards the substrate;

refilling a firing chamber of said dispenser with a second quantity of fluid less than said first quantity;

ejecting said second quantity of said fluid from said inkjet dispenser toward said substrate; and moving the inkjet dispenser relative to the substrate;

wherein said second quantity of fluid is ejected from said inkjet dispenser such that said first quantity of said fluid and said second quantity of said fluid join to form the single, continuous ligament of said fluid on said substrate; and wherein said ligament consists of a plurality of fluid heads and tails.

19. The method of claim 18, wherein said refilling a firing chamber with a second quantity of fluid less than said first quantity is performed by increasing backpressure in said firing chamber.

20. The method of claim 18, wherein said refilling a firing chamber with a second quantity of fluid less than said first quantity is performed by increasing a viscosity of said fluid.

21. The method of claim 18, wherein said refilling a firing chamber with a second quantity of fluid less than said first quantity is performed by decreasing impedance of an orifice of said firing chamber.

22. The method of claim 18, wherein said refilling a firing chamber with a second quantity of fluid less than said first quantity is performed by increasing impedance of an inlet of said firing chamber.

* * * * *

UNITED STATES PATENT AND TRADEMARK OFFICE

CERTIFICATE OF CORRECTION

PATENT NO. : 7,219,970 B2
APPLICATION NO. : 10/685842
DATED : May 22, 2007
INVENTOR(S) : Tony S. Cruz-Uribe et al.

It is certified that error appears in the above-identified patent and that said Letters Patent is hereby corrected as shown below:

In column 5, line 49, delete “baffler” and insert -- barrier --, therefor.

In column 5, line 52, delete “paint” and insert -- point --, therefor.

In column 6, line 13, delete “Fixing” and insert -- Firing --, therefor.

Signed and Sealed this

Nineteenth Day of May, 2009

JOHN DOLL
*Acting Director of the United States Patent and Trademark Office*